US010060270B2

(12) United States Patent
Lee et al.

(10) Patent No.: US 10,060,270 B2
(45) Date of Patent: Aug. 28, 2018

(54) INTERNAL COOLING SYSTEM WITH CONVERGING-DIVERGING EXIT SLOTS IN TRAILING EDGE COOLING CHANNEL FOR AN AIRFOIL IN A TURBINE ENGINE

(71) Applicant: Siemens Energy, Inc., Orlando, FL (US)

(72) Inventors: Ching-Pang Lee, Cincinnati, OH (US); Caleb Myers, Cincinnati, OH (US); Erik Johnson, Cedar Park, TX (US); Steven Koester, Toledo, OH (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/552,882

(22) PCT Filed: Mar. 17, 2015

(86) PCT No.: PCT/US2015/020858
§ 371 (c)(1),
(2) Date: Aug. 23, 2017

(87) PCT Pub. No.: WO2016/148693
PCT Pub. Date: Sep. 22, 2016

(65) Prior Publication Data

US 2018/0038233 A1 Feb. 8, 2018

(51) Int. Cl.
*F01D 5/18* (2006.01)

(52) U.S. Cl.
CPC ..... *F01D 5/187* (2013.01); *F05D 2240/122* (2013.01); *F05D 2240/304* (2013.01)

(58) Field of Classification Search
CPC ... F01D 5/08; F01D 9/02; F01D 9/065; F01D 5/187; F05D 2240/122; F05D 2240/304
See application file for complete search history.

(56) References Cited

U.S. PATENT DOCUMENTS 3,973,874 A 8/1976 Corsmeier et al.
4,257,734 A 3/1981 Guy et al.
(Continued)

FOREIGN PATENT DOCUMENTS

EP 0541207 A1 5/1993
EP 1431514 A2 6/2004

OTHER PUBLICATIONS

PCT International Search Report and Written Opinion dated Mar. 11, 2015 corresponding to PCT Application PCT/US2015/020858 filed Mar. 17, 2015.

*Primary Examiner* — Logan Kraft
*Assistant Examiner* — Eric Zamora Alvarez

(57) ABSTRACT

An airfoil (10) is disclosed for a gas turbine engine in which the airfoil (10) includes an internal cooling system (14) with one or more converging-diverging exit slots (20) configured to increase the effectiveness of the cooling system (14) at the trailing edge (34) of the airfoil (10) by increasing the contact of cooling fluids with internal surfaces (24, 30) of the pressure and suction sides (36, 38) of the airfoil (10). In at least one embodiment, the trailing edge cooling channel (18) may include one or more converging-diverging exit slots (20) to further pressurize the trailing edge cooling channel (18) and may be formed by a first and second ribs (80, 82) extending between an outer walls (13, 12) forming the pressure and suction sides (36, 38). The converging-diverging exit slot (20) may be formed from a first converging section (84) having an inlet (86) with a larger cross-sectional area than an outlet (88) and is formed from a second diverging section (90) having an inlet (92) with a smaller cross-sectional area than an outlet (94).

17 Claims, 9 Drawing Sheets

(56) References Cited

U.S. PATENT DOCUMENTS

| | | | | |
|---|---|---|---|---|
| 4,403,917 | A | 9/1983 | Laffitte et al. | |
| 5,027,604 | A | 7/1991 | Krueger | |
| 5,243,759 | A * | 9/1993 | Brown | B22C 9/10 164/122.1 |
| 5,246,341 | A * | 9/1993 | Hall | F01D 5/187 416/97 R |
| 5,253,976 | A | 10/1993 | Cunha | |
| 5,297,946 | A | 3/1994 | Yoshida et al. | |
| 5,533,864 | A | 7/1996 | Nomoto et al. | |
| 5,591,002 | A | 1/1997 | Cunha et al. | |
| 5,624,231 | A | 4/1997 | Ohtomo et al. | |
| 6,036,436 | A | 3/2000 | Fukuno et al. | |
| 6,174,135 | B1 | 1/2001 | Lee | |
| 6,183,194 | B1 | 2/2001 | Cunha et al. | |
| 6,273,682 | B1 | 8/2001 | Lee | |
| 6,499,949 | B2 | 12/2002 | Schafrik et al. | |
| 6,551,063 | B1 | 4/2003 | Lee et al. | |
| 6,602,047 | B1 * | 8/2003 | Barreto | F01D 5/187 415/1 |
| 6,969,230 | B2 * | 11/2005 | Shi | F01D 5/187 415/115 |
| 7,387,492 | B2 | 6/2008 | Pang et al. | |
| 7,452,186 | B2 * | 11/2008 | Charbonneau | F01D 5/187 416/97 R |
| 7,503,749 | B2 | 3/2009 | Lee et al. | |
| 7,575,414 | B2 | 8/2009 | Lee | |
| 7,736,123 | B2 | 6/2010 | Lee et al. | |
| 8,172,504 | B2 | 5/2012 | Flodman et al. | |
| 8,197,210 | B1 | 6/2012 | Liang | |
| 8,348,613 | B2 | 1/2013 | Gregg et al. | |
| 8,403,631 | B2 | 3/2013 | Surace et al. | |
| 8,500,405 | B1 | 8/2013 | Jones et al. | |
| 8,840,363 | B2 | 9/2014 | Lee | |
| 2002/0141870 | A1 | 10/2002 | Schafrik et al. | |
| 2002/0187043 | A1 | 12/2002 | Liang | |
| 2003/0068222 | A1 | 4/2003 | Cunha et al. | |
| 2005/0281671 | A1 | 12/2005 | Liang | |
| 2006/0222496 | A1 | 10/2006 | Lee et al. | |
| 2006/0222497 | A1 | 10/2006 | Lee | |
| 2007/0110585 | A1 | 5/2007 | Bonnet | |
| 2007/0140850 | A1 | 6/2007 | Pang et al. | |
| 2008/0145233 | A1 | 6/2008 | Lee et al. | |
| 2009/0245999 | A1 | 10/2009 | Flodman et al. | |
| 2010/0054915 | A1 | 3/2010 | Devore et al. | |
| 2010/0074763 | A1 | 3/2010 | Liang | |
| 2010/0247284 | A1 | 9/2010 | Gregg et al. | |
| 2011/0070097 | A1 | 3/2011 | Surace et al. | |
| 2011/0107769 | A1 | 5/2011 | Stevenson et al. | |
| 2013/0064681 | A1 | 3/2013 | Lee | |
| 2013/0142666 | A1 | 6/2013 | Lee et al. | |
| 2013/0302178 | A1 | 11/2013 | Bergholz et al. | |
| 2014/0110559 | A1 | 4/2014 | Lee et al. | |
| 2014/0112799 | A1 | 4/2014 | Lee et al. | |
| 2014/0321980 | A1 | 10/2014 | Lee et al. | |

* cited by examiner

- TRAILING EDGE TEMPERATURE IS REDUCED BY ~100°C WITH THE ENHANCED COOLING TE SLOTS DESIGN
- THIS DESIGN USED 2% LESS OF THE AIRFOIL SUPPLY FOR THE AFT CIRCUIT THAT WAS APPLIED TO THE FWD CIRCUIT TO IMPROVE TIP COOLING

INTERNAL COOLING SYSTEM WITH CONVERGING-DIVERGING EXIT SLOTS IN TRAILING EDGE COOLING CHANNEL FOR AN AIRFOIL IN A TURBINE ENGINE

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to gas turbine engines, and more particularly to internal cooling systems for airfoils in gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine airfoils are exposed to high temperature combustor gases that heat the airfoils. The airfoils include internal cooling systems for reducing the temperature of the airfoils. Many conventional cooling systems include linear exit slots at the trailing edge, as shown in FIG. 10. The exit slots are linear with uniform cross-sections in the chordwise direction. These blades typically experience high temperatures in the trailing edge region. The linear exit slots foster minimal contact with the cooling fluid flowing therethrough, thereby resulting in limited effectiveness. Thus, a need exists for improved cooling efficiency at the airfoil trailing edge.

SUMMARY OF THE INVENTION

An airfoil is disclosed for a gas turbine engine in which the airfoil includes an internal cooling system with one or more converging-diverging exit slots configured to increase the effectiveness of the cooling system at the trailing edge of the airfoil by increasing the contact of cooling fluids with internal surfaces of the pressure and suction sides of the airfoil. In at least one embodiment, the trailing edge cooling channel may include one or more converging-diverging exit slots to further pressurize the trailing edge cooling channel and may be formed by a first rib extending between an outer walls forming the pressure and suction sides and a second rib extending between the outer wall forming the pressure and suction sides. The converging-diverging exit slot may be formed from a first converging section having an inlet with a larger cross-sectional area than an outlet and is formed from a second diverging section having an inlet with a smaller cross-sectional area than an outlet. One or more mini-ribs may extend into the converging-diverging exit slot to direct cooling fluid toward the pressure and suction sides of the airfoil to enhance cooling effectiveness of the cooling system.

In at least one embodiment, the turbine airfoil for a gas turbine engine may be formed from a generally elongated hollow airfoil formed from an outer wall, and having a leading edge, a trailing edge, a pressure side, a suction side and a cooling system positioned within interior aspects of the generally elongated hollow airfoil. The cooling system may include one or more trailing edge cooling channels positioned at the trailing edge of the airfoil. The trailing edge cooling channel may include one or more converging-diverging exit slots formed by a first rib extending between the outer wall forming the pressure side and the outer wall forming the suction side and a second rib extending between the outer wall forming the pressure side and the outer wall forming the suction side. The converging-diverging exit slot may be formed from a converging section having an inlet with a larger cross-sectional area than an outlet and may be formed from a diverging section having an inlet with a smaller cross-sectional area than an outlet.

The converging-diverging exit slot may include one or more mini-ribs extending from the pressure side into the converging-diverging exit slot. The converging-diverging exit slot may include one or more mini-ribs extending from the suction side into the converging-diverging exit slot. The converging-diverging exit slot may include one or more mini-ribs positioned in the diverging section such that the at least one mini-ribs extend downstream and from a cooling fluid flow path axis in different directions to enhance diffusion of cooling fluid exhausted from the diverging section. In at least one embodiment, a plurality of mini-ribs may extend from the pressure side into the converging section of the converging-diverging exit slot, and a plurality of mini-ribs may extend from the suction side into the diverging section of the converging-diverging exit slot.

The trailing edge cooling channel may include one or more, or a plurality of cooling fluid flow controllers extending from the outer wall forming the pressure side to the outer wall forming the suction side of the generally elongated hollow airfoil. The cooling fluid flow controllers may form a plurality of alternating zigzag channels extending downstream toward the trailing edge. The cooling fluid flow controllers may be positioned upstream from the at least one converging-diverging exit slot.

During use, cooling fluid, such as, but no limited to, air, may be supplied from a compressor or other such cooling air source to the trailing edge cooling channel. The cooling fluid may strike and pass between one or more rows of cooling fluid controllers forming alternating zigzag channels. The cooling fluid may also strike and flow past a plurality of pin fins. The cooling fluid may enter one or more converging-diverging exit slots. In particular, the cooling fluid may flow into inlets of converging sections. The cooling fluid may strike a mini-rib on the pressure side and be directed towards the suction side. The cooling fluid may also strike a mini-rib on the suction side and be directed towards the pressure side. The cooling fluid may also strike one or more of the mini-ribs extending from either or both of the first and second ribs. The mini-ribs induce turbulence in the cooling fluid flow path and increase heat transfer. The converging sections reduce the flow path between the inlet and the outlet, thereby increasing pressure within the trailing edge cooling channel and increasing the velocity of cooling fluid within the converging sections.

The cooling fluid may flow through the outlet of the converging section into the inlet of the diverging section. The velocity of the cooling fluid in the diverging section is reduced. The mini-ribs positioned within the diverging section direct cooling fluid partially downstream and partially radially inward or outward to diffuse the cooling fluid flow path through the diverging section. The cooling fluid may be exhausted from the outlet of the diverging section before being exhausted from the trailing edge of the airfoil. The cooling fluid may be exhausted from the outlet of the diverging section into a trailing edge slot that may extend an entire length or part of a length of the trailing edge cooling channel. In at least one embodiment, the trailing edge slot may be a single slot.

Analysis has shown that the internal cooling system is capable of reducing the temperature of the outer walls forming the trailing edge by up to about 100 degrees Celsius compared with conventional linear axial slots at an airfoil trailing edge. In addition, embodiments of the internal cooling system with cooling fluid flow controllers may be capable of reducing the temperature of the outer walls forming the trailing edge by up to about 150 degrees Celsius compared with conventional linear axial slots at an airfoil trailing edge.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
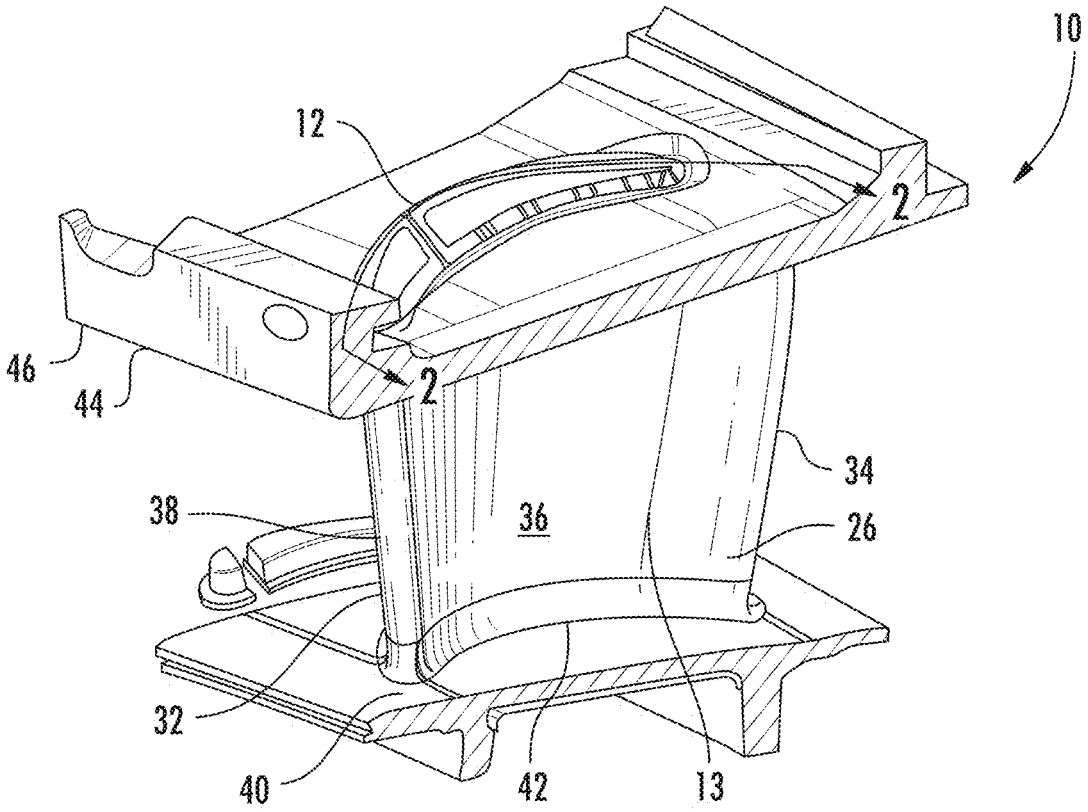
FIG. 1 is a perspective view of a turbine airfoil vane including the internal cooling system.

As shown in FIGS. 1-9, 11-14, 16 and 17, a turbine airfoil 10 is disclosed for a gas turbine engine in which the airfoil 10 includes an internal cooling system 14 with one or more converging-diverging exit slots 20 configured to increase the effectiveness of the cooling system 14 at the trailing edge 34 of the airfoil 10 by increasing the contact of cooling fluids with internal surfaces 24, 30 of the pressure and suction sides 36, 38 of the airfoil 10. In at least one embodiment, the trailing edge cooling channel 18 may include one or more converging-diverging exit slots 20 to further pressurize the trailing edge cooling channel 18 and may be formed by a first rib 80 extending between an outer walls 13, 12 forming the pressure and suction sides 36, 38 and a second rib 82 extending between the outer wall 13, 12 forming the pressure and suction sides 36, 38. The converging-diverging exit slot 20 may be formed from a first converging section 84 having an inlet 86 with a larger cross-sectional area than an outlet 88 and is formed from a second diverging section 90 having an inlet 92 with a smaller cross-sectional area than an outlet 94. One or more mini-ribs 96, 98, 100 may extend into the converging-diverging exit slot 20 to direct cooling fluid toward the pressure and suction sides 36, 38 of the airfoil 10 to enhance cooling effectiveness of the cooling system 14.

Figure 3:
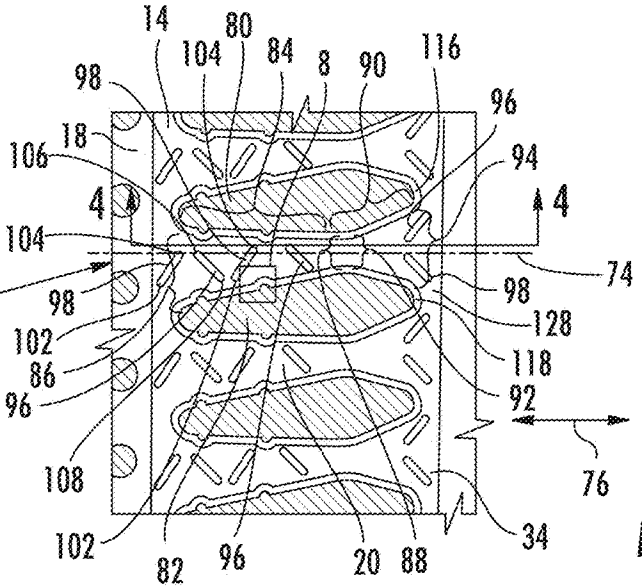
FIG. 3 is a detail view of the trailing edge cooling channel of the internal cooling system including converging-diverging exit slots, taken at detail 3 in FIG. 2.
Figure 4:
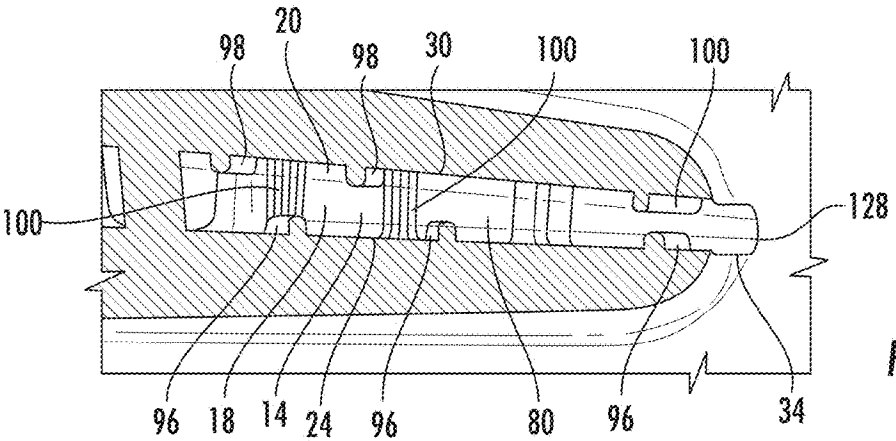
FIG. 4 is a partial cross-sectional, side detail view of the trailing edge cooling channel with converging-diverging exit slots taken along section line 4-4 in FIG. 3.
Figure 5:
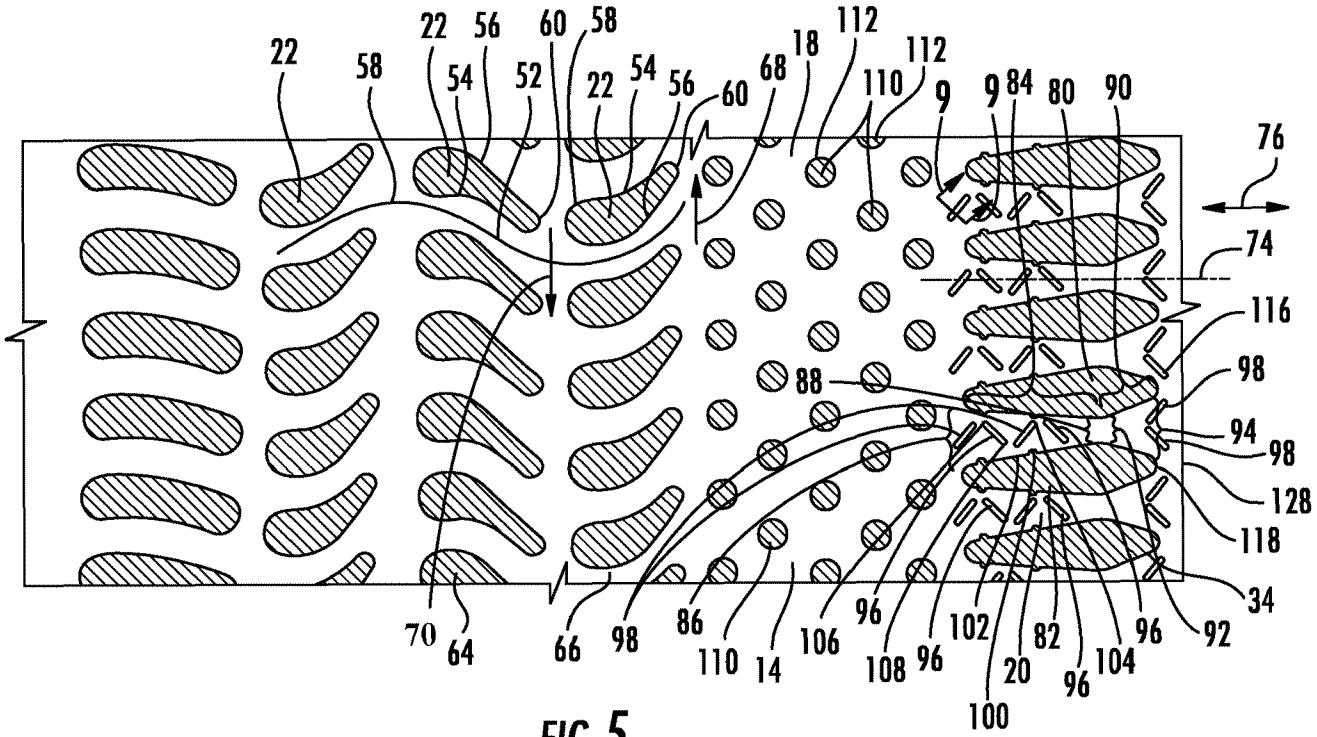
FIG. 5 is a detail view of the trailing edge cooling channel of the internal cooling system including converging-diverging exit slots, taken at detail 5 in FIG. 2.
Figure 8:
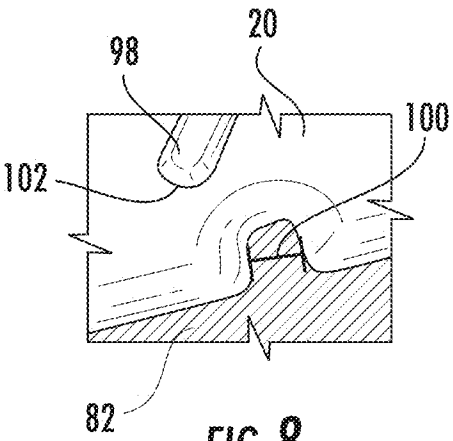
FIG. 8 is a detail view of a rib forming a converging-diverging exit slot and a mini-rib extending therefrom in the trailing edge cooling channel of the internal cooling system, taken at detail 8 in FIG. 3.
Figure 9:
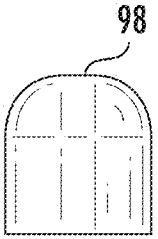
FIG. 9 is a cross-sectional, detail view of a mini-rib on the suction side, as taken at section line 9-9 in FIG. 5.

In at least one embodiment, as shown in 1 and 17, the generally elongated hollow airfoil 26 formed from an outer wall 12, 13, and having a leading edge 32, a trailing edge 34, a pressure side 36, a suction side 38 and a cooling system 14 positioned within interior aspects of the generally elongated hollow airfoil 26. The cooling system 14, as shown in FIGS. 3 and 5, may include one or more trailing edge cooling channels 18 positioned at the trailing edge 34 of the airfoil 26. The trailing edge cooling channel 18 may include one or more converging-diverging exit slots 20 formed by a first rib 80 extending between the outer wall 13 forming the pressure side 36 and the outer wall 12 forming the suction side 38 and a second rib 82 extending between the outer wall 13 forming the pressure side 36 and the outer wall 12 forming the suction side 38. The cooling system 14 may include one or more converging-diverging exit slots 20 formed from a converging section 84 having an inlet 86 with a larger cross-sectional area than an outlet 88 and formed from a diverging section 90 having an inlet 92 with a smaller cross-sectional area than an outlet 94. The inlet 92 of the diverging section 90 may be in direct fluid communication with the outlet 88 of the converging section 84. In at least one embodiment, the inlet 92 of the diverging section 90 may be coupled to the outlet 88 of the converging section 84 and may be positioned immediately downstream of the converging section 84.

Figure 17:
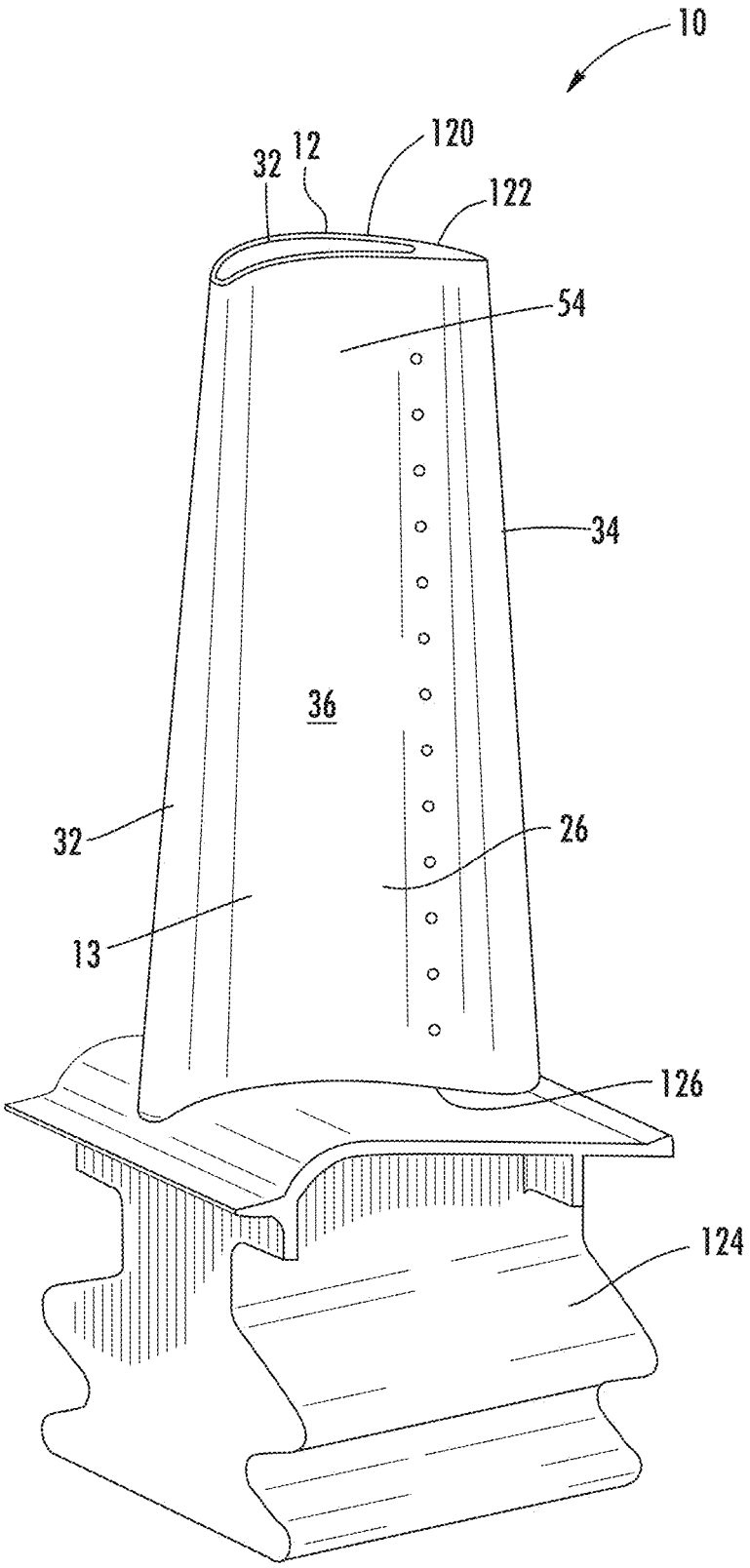
FIG. 17 is a perspective view of a turbine airfoil, such as a turbine blade, including the internal cooling system.

The cooling system 14 and converging-diverging exit slot 20 may be positioned within a turbine blade or turbine vane. For example, in at least one embodiment, as shown in FIG. 17, the generally elongated hollow airfoil 26 may be formed from a rotary turbine blade having a tip 120 at a first end 122 and a root 124 at a second end 126 at an opposite end of the airfoil 26 to the first end 122. In another embodiment, as shown in FIG. 1, the generally elongated hollow airfoil 26 may be formed from a stationary turbine vane formed from an inner endwall 40 at a first end 42 and an outer endwall 44 at a second end 46 that is generally on an opposite side of the generally elongated hollow airfoil 26 from the first end 42.

As shown in FIGS. 3 and 5, the converging-diverging exit slot 20 may be configured such that a chordwise extending length of the converging section 84 is greater than a chordwise extending length of the diverging section 90. In at least one embodiment, a chordwise extending length of the converging section 84 may be between 1.5 times and four times longer than the chordwise extending length of the diverging section 90. The chordwise extending length of the converging section 84 may be between two times and three times longer than the chordwise extending length of the diverging section 90. The converging-diverging exit slot 20 may also be configured such that a chordwise extending length of the diverging section 90 is greater than a chordwise extending length of the converging section 84. In at least one embodiment, a downstream end 116 of the first rib 80 and a downstream end 118 of the second rib 82 may terminate upstream from the trailing edge 34 to improve cooling and reduce metal temperature.

The outlet 88 of the converging section 84, as shown in FIGS. 3 and 5, may have a cross-sectional area that is at least 25% less then a cross-sectional area of the inlet 86 of the converging section 84. In at least one embodiment, the outlet 88 of the converging section 84 may have a cross-sectional area that is about 33% less then a cross-sectional area of the inlet 86 of the converging section 84. The converging-diverging exit slot 20 may also be configured such that a cross-sectional area of the inlet 86 of the converging section 84 is about equal to a cross-sectional area of the outlet 94 of the diverging section 90.

The cooling system 14 may also include at least one mini-rib 96 extending from the pressure side 36 into the converging-diverging exit slot 20, as shown in FIGS. 3-5 and 7. The mini-rib 96 extending into the converging-diverging exit slot 20 may be nonparallel and nonorthogonal with a cooling fluid flow path axis 74 extending through the converging-diverging exit slot 20. In at least one embodiment, the converging-diverging exit slot 20 may include a plurality of mini-ribs 96 extending from the pressure side 36 into the converging-diverging exit slot 20.

The cooling system 14 may also include at least one mini-rib 98 extending from the suction side 38 into the converging-diverging exit slot 20. In at least one embodiment, one or more, or a plurality of mini-ribs (98) may be positioned within the converging section (84). The mini-rib 98 extending into the converging-diverging exit slot 20 may be nonparallel and nonorthogonal with a cooling fluid flow path axis 74 extending through the converging-diverging exit slot 20. The mini-rib 98 extending into the converging-diverging exit slot 20 may have a leading end 102 positioned closer to the second rib 82 than a trailing end 104, and the at least one mini-rib 96 extending into the converging-diverging exit slot 20 may have a leading end 106 positioned closer to the first rib 80 than a trailing end 108. As such, cooling fluid passing through the converging-diverging exit slot 20 will be directed in different directions towards the pressure side 36 and the suction sides 38, which enhances the cooling capacity of the converging-diverging exit slot 20. The mini-rib 98 extending into the converging-diverging exit slot 20 may be offset in a chordwise direction 76 from the mini-rib 96 such that the mini-ribs 96, 98 do not overlap in a direction extending from the pressure side 36 towards the suction side 38. In at least one embodiment, the converging-diverging exit slot 20 may include a plurality of mini-ribs 98 extending from the suction side 38 into the converging-diverging exit slot 20. As shown in FIGS. 3 and 5, the mini-ribs 96, 98 may be positioned in the diverging section 90 such that the mini-ribs 96, 98 extend downstream and from a cooling fluid flow path axis 74 in different directions to enhance diffusion of cooling fluid exhausted from the diverging section 90.

The mini-ribs 96, 98 may have any appropriate size and shape. In at least one embodiment, a height and width of the mini-ribs 96, 98 may be generally equal. In other embodiment, the height and width of the mini-ribs 96, 98 may differ. Outer corners of one or more of the mini-ribs 96, 98 may be filleted for an entire length of the mini-rib 96, 98 or only a portion. The mini-ribs 96, 98 may extend into the cooling fluid flow path less than 25 percent.

The cooling system 14 may also include one or more mini-ribs 100, as shown in FIGS. 3, 3-5 and 8, extending from the first rib 80 toward the second rib 82 in the converging section 84. The cooling system 14 may also include one or more mini-ribs 100 extending from the second rib 82 toward the first rib 80 in the converging section 84. The mini-rib 100 extending from the first rib 80 may be aligned with the mini-rib 100 extending from the second rib 82. The mini-ribs 100 may have any appropriate size and shape. In at least one embodiment, a height and width of the mini-ribs 100 may be generally equal. In other embodiment, the height and weight of the mini-ribs 100 may differ. Outer corners of one or more of the mini-ribs 100 may be filleted for an entire length of the mini-rib 100 or only a portion. The mini-ribs 100 may extend into the cooling fluid flow path less than 20 percent.

Figure 2:
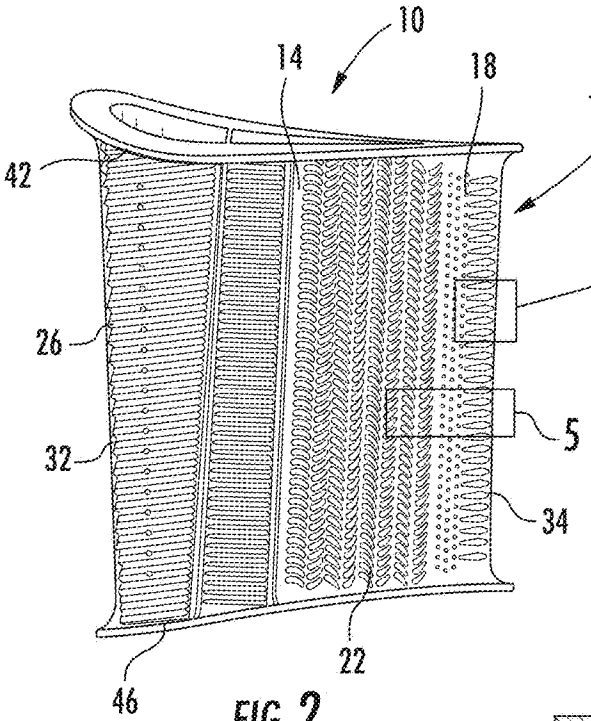
FIG. 2 is a partial perspective view of the turbine airfoil of FIG. 1, taken along section line 2-2 in FIG. 1.
Figure 10:
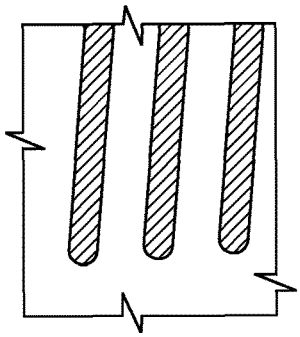
FIG. 10 PRIOR ART
FIG. 10 is a partial cross-sectional view of a trailing edge cooling channel with linear exhaust slots of a conventional turbine airfoil.

The cooling system 14 may also include one or more, such as a plurality, of cooling fluid flow controllers 22, as shown in FIGS. 2 and 5, extending from the outer wall 13 forming the pressure side 36 to the outer wall 12 forming the suction side 38 of the generally elongated hollow airfoil 26, where the cooling fluid flow controllers 22 form a plurality of alternating zigzag channels 52 extending downstream toward the trailing edge 34. The plurality of cooling fluid flow controllers 22 may be positioned upstream from one or more converging-diverging exit slots 20. The cooling fluid flow controllers 22 may be formed by a pressure side 54 that is on an opposite side from a suction side 56. The pressure and suction sides 54, 56 may be coupled together via a leading edge 58 and trailing edge 60 on an opposite end of the cooling fluid flow controller 22 from the leading edge 58. The pressure side 54 may have a generally concave curved surface and the suction side 56 and may have a generally convex curved surface.

The plurality of cooling fluid flow controllers 22 may be collected into a first spanwise extending row 64 of cooling fluid flow controllers 22 and a second spanwise extending row 66. Each of the cooling fluid flow controllers 22 within the first spanwise extending row 64 of cooling fluid flow controllers 22 may be positioned similarly such that a pressure side 54 of one cooling fluid flow controller 22 is adjacent to a suction side 56 of an adjacent cooling fluid flow controller 22, except for a cooling fluid flow controller 22 at an end of the first spanwise extending row 64. The spanwise extending row 66 of cooling fluid flow controllers 22 may be positioned downstream from the first spanwise extending row 64 of cooling fluid flow controllers 22. The second spanwise extending row 66 of cooling fluid flow controllers 22 may have one or more cooling fluid flow controllers 22 with a pressure side 54 on an opposite side of the cooling fluid flow controller 22 than in the first spanwise extending row 64 of cooling fluid flow controllers 22, thereby causing cooling fluid flowing through the second spanwise extending row 66 of cooling fluid flow controllers 22 to be directed downstream with a spanwise vector 68 that is opposite to a spanwise vector 70 imparted on the cooling fluid by the first spanwise extending row 64 of cooling fluid flow controllers 22.

The trailing edge channel 18 of the cooling system 14 may include one or more rows of pin fins 110 extending from the outer wall 13 forming the pressure side 36 to the outer wall 112 forming the suction side 38 and downstream from the cooling fluid flow controllers 22. The pin fins 110 may have a generally circular cross-sectional area or other appropriate shape. The pin fins 110 may be positioned in one or more spanwise extending rows 112 of pin fins 110. In at least one embodiment, the pin fins 110 may have a minimum distance between each other or between an adjacent structure other than the outer walls 12, 13 of about 1.5 millimeters.

During use, cooling fluid, such as, but no limited to, air, may be supplied from a compressor or other such cooling air source to the trailing edge cooling channel 18. The cooling fluid may strike and pass between one or more rows 64, 66 of cooling fluid controllers 22 forming alternating zigzag channels 52. The cooling fluid may also strike and flow past a plurality of pin fins 110. The cooling fluid may enter one or more converging-diverging exit slots 20. In particular, the cooling fluid may flow into inlets 86 of converging sections 84. The cooling fluid may strike a mini-rib 96 on the pressure side 36 and be directed towards the suction side 38. The cooling fluid may also strike a mini-rib 98 on the suction side 38 and be directed towards the pressure side 36. The cooling fluid may also strike one or more of the mini-ribs 100 extending from either or both of the first and second ribs 80, 82. The mini-ribs 100 induce turbulence in the cooling fluid flow path and increase heat transfer. The converging sections 84 reduce the flow path between the inlet 86 and the outlet 88, thereby increasing pressure within the trailing edge cooling channel 18 and increasing the velocity of cooling fluid within the converging sections 84.

Figure 7:
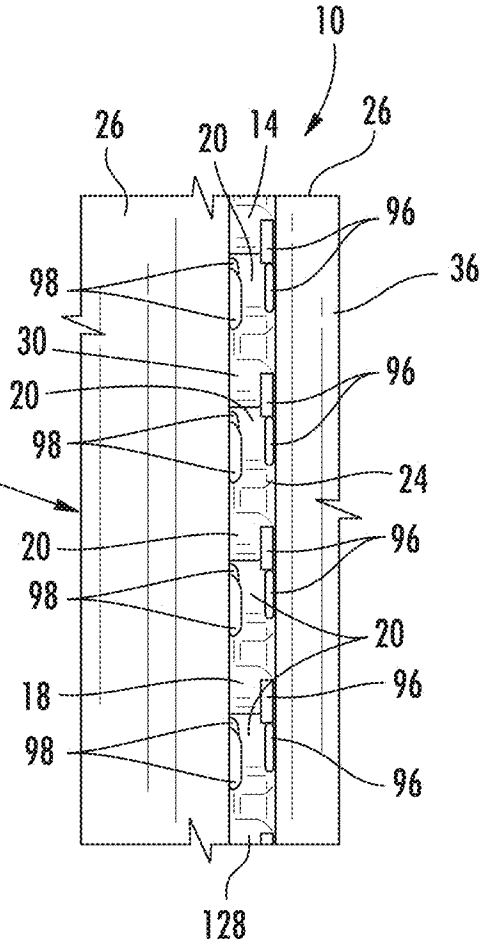
FIG. 7 is a detail view of the trailing edge cooling channel of the internal cooling system including converging-diverging exit slots, taken at detail 7 in FIG. 6.
Figure 6:
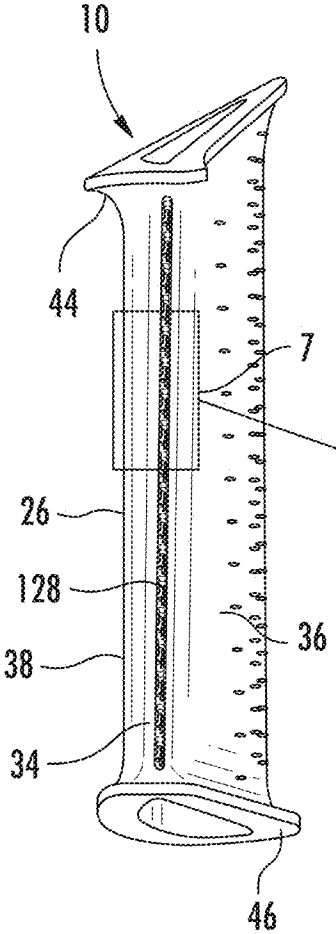
FIG. 6 is a perspective view of the trailing edge of the turbine airfoil vane of FIG. 1 including a trailing edge slot of the internal cooling system.

The cooling fluid may flow through the outlet 88 of the converging section 84 into the inlet 92 of the diverging section 90. The velocity of the cooling fluid in the diverging section 90 is reduced. The mini-ribs 96, 98 positioned within the diverging section 90 direct cooling fluid partially downstream and partially radially inward or outward to diffuse the cooling fluid flow path through the diverging section 90. The cooling fluid may be exhausted from the outlet 94 of the diverging section 90 before being exhausted from the trailing edge 34 of the airfoil 26. The cooling fluid may be exhausted from the outlet 94 of the diverging section 90 into a trailing edge slot 128, as shown in FIGS. 6 and 7, that may extend an entire length or part of a length of the trailing edge cooling channel 18. In at least one embodiment, the trailing edge slot 128 may be a single slot 128.

Figure 12:
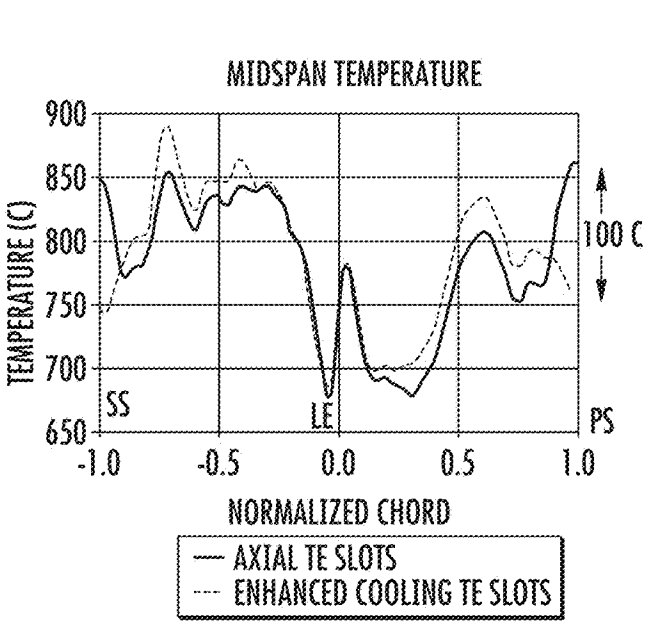
FIG. 12 is a graph of the midspan, trailing edge temperature of an airfoil, such as a turbine blade, with an internal cooling system with converging-diverging exit slots in a trailing edge cooling channel shown in FIG. 5 compared with an airfoil with an internal cooling system with linear exhaust slots shown in FIG. 10.
Figure 11:
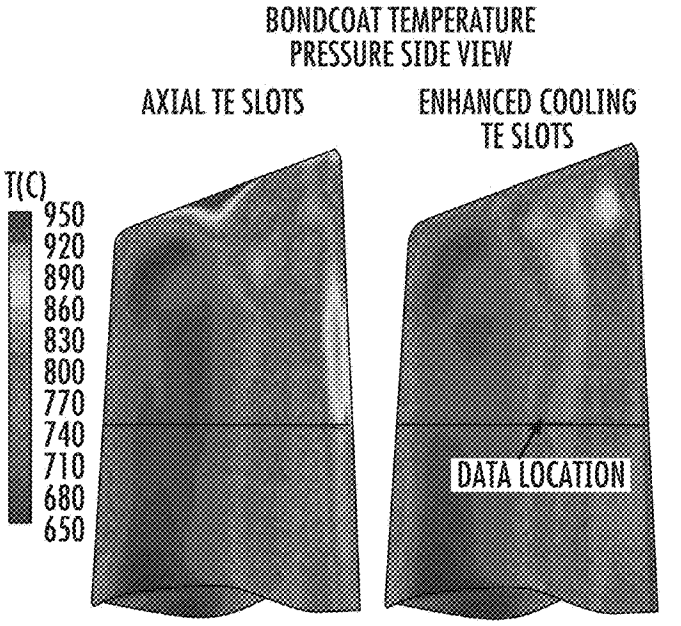
FIG. 11 is a diagram of an analysis showing the better cooling of an airfoil with an internal cooling system with converging-diverging exit slots in a trailing edge cooling channel shown in FIG. 5 than an airfoil with an internal cooling system with linear exhaust slots shown in FIG. 10.
Figure 13:
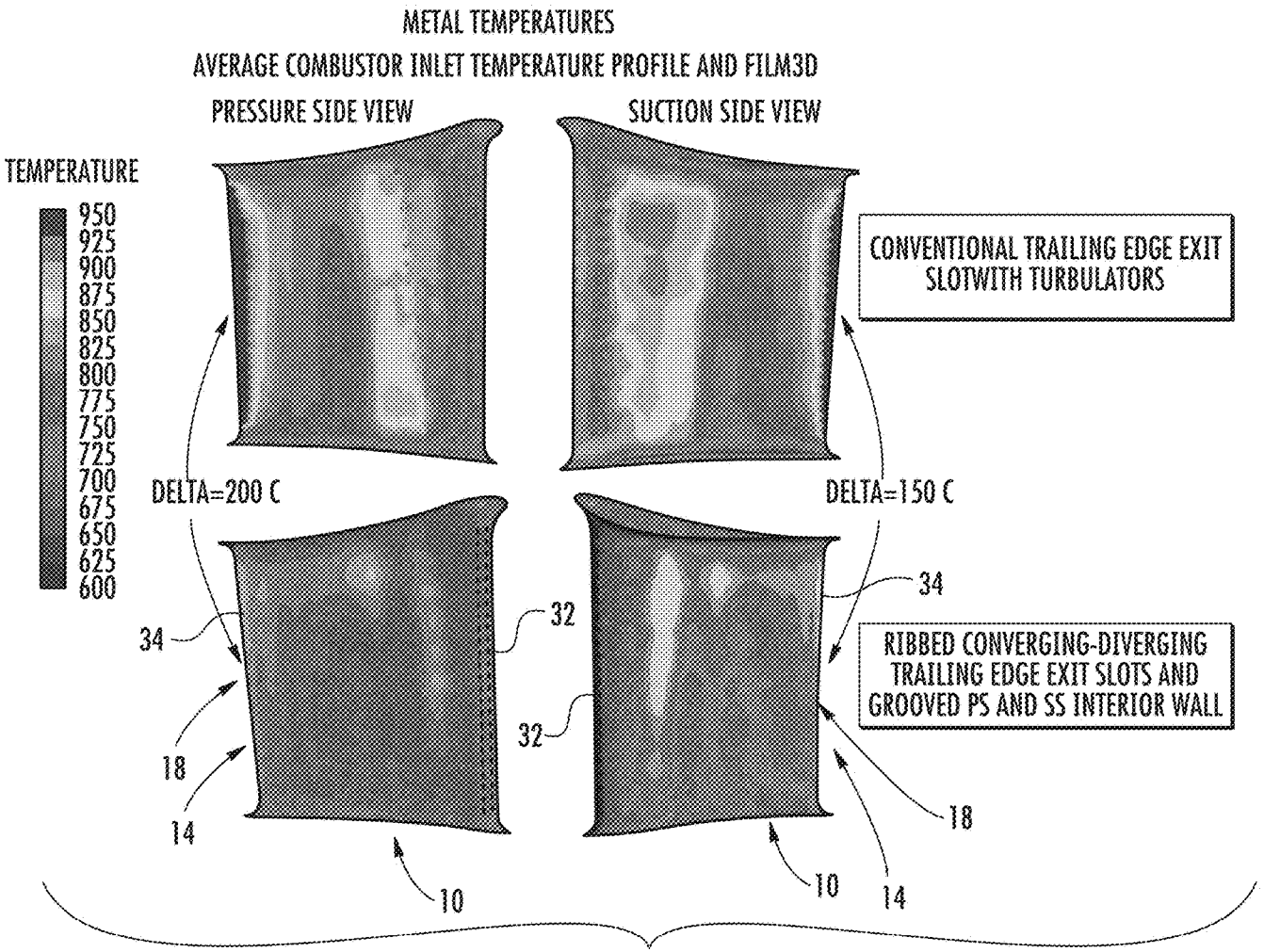
FIG. 13 is a collection of diagrams showing the metal temperatures of an airfoil, such as a turbine blade, with an internal cooling system with converging-diverging exit slots in a trailing edge cooling channel shown in FIG. 5 compared with an airfoil with an internal cooling system with linear exhaust slots shown in FIG. 10.
Figure 14:
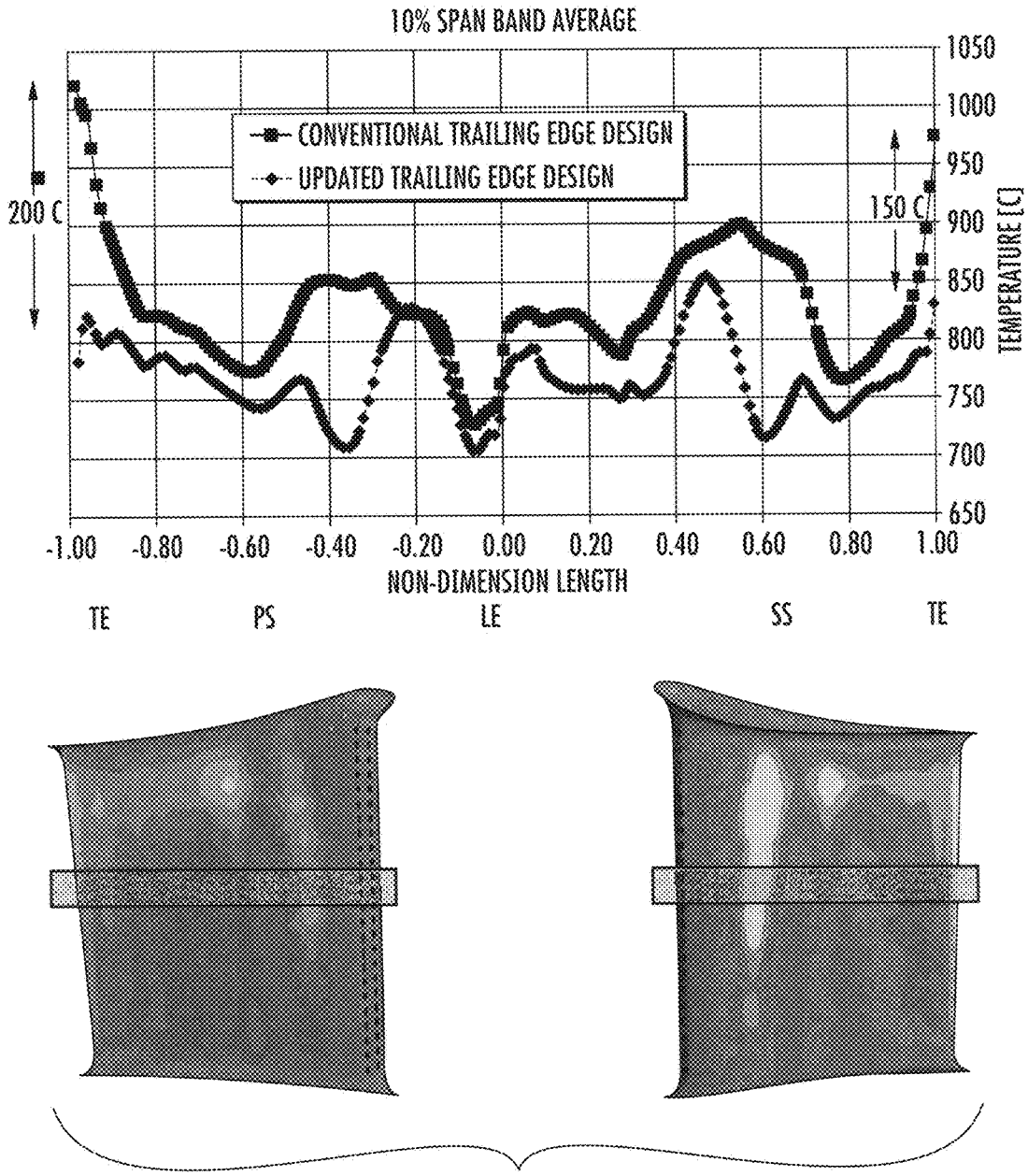
FIG. 14 is a graph of the midspan, trailing edge temperature of an airfoil, such as a turbine vane, with an internal cooling system with converging-diverging exit slots in a trailing edge cooling channel shown in FIG. 5 compared with an airfoil with an internal cooling system with linear exhaust slots shown in FIG. 10, as taken along the designated midspan location shown on the pressure and suction sides of the airfoil.
Figures 15, 16:
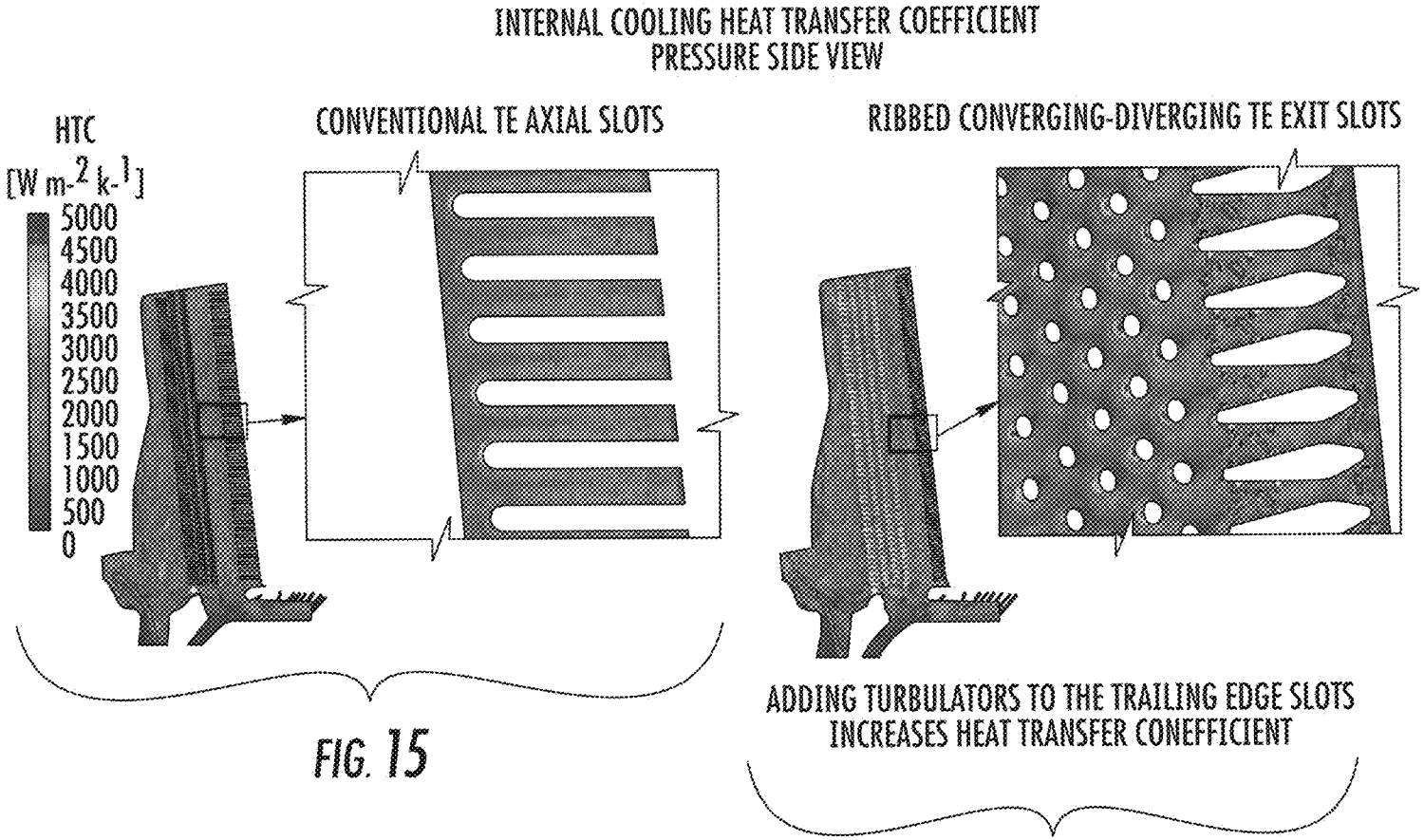
FIG. 15 is a diagram showing the internal heat transfer coefficient of linear axial trailing edge slots.
FIG. 16 is a diagram showing the internal heat transfer coefficient of an airfoil with an internal cooling system with converging-diverging exit slots in a trailing edge cooling channel shown in FIG. 5.

Analysis has shown that the internal cooling system 14 is capable of reducing the temperature of the outer walls 12, 13 forming the trailing edge 34 of an airfoil 26, such as a blade, by up to about 100 degrees Celsius compared with conventional linear axial slots at an airfoil trailing edge, as shown in FIG. 12. In addition, embodiments of the internal cooling system 14 with cooling fluid flow controllers 22 may be capable of reducing the temperature of the outer walls 12, 13 forming the trailing edge 34 by up to about 150 degrees Celsius compared with conventional linear axial slots at a vane airfoil trailing edge, as shown in FIGS. 13 and 14, with an increased heat transfer coefficient, as shown in FIG. 16, versus a heat transfer coefficient of a conventional blade airfoil with linear exhaust orifices, as shown in FIG. 15.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil for a gas turbine engine comprising:

a generally elongated hollow airfoil formed from an outer wall, and having a leading edge, a trailing edge, a pressure side, a suction side and a cooling system positioned within interior aspects of the generally elongated hollow airfoil;

the cooling system includes at least one trailing edge cooling channel positioned at the trailing edge of the airfoil;

wherein the at least one trailing edge cooling channel includes at least one converging-diverging exit slot formed by a first rib extending between the outer wall forming the pressure side and the outer wall forming the suction side and a second rib extending between the outer wall forming the pressure side and the outer wall forming the suction side;

wherein the at least one converging-diverging exit slot is formed from a converging section having an inlet with a larger cross-sectional area than an outlet and is formed from a diverging section having an inlet with a smaller cross-sectional area than an outlet, at least one mini-rib extending from the pressure side into the converging-diverging exit slot, at least one mini-rib extending from the suction side into the converging-diverging exit slot, wherein the at least one mini-ribs are positioned in the diverging section such that the at least one mini-ribs extend downstream and from a cooling fluid flow path axis in different directions to enhance diffusion of cooling fluid exhausted from the diverging section.

2. The turbine airfoil of claim 1, wherein a chordwise extending length of the converging section is greater than a chordwise extending length of the diverging section.

3. The turbine airfoil of claim 2, wherein a chordwise extending length of the converging section is between 1.5 times and 4 times longer than the chordwise extending length of the diverging section.

4. The turbine airfoil of claim 1, wherein the outlet of the converging section has a cross-sectional area that is at least 25% less than a cross-sectional area of the inlet of the converging section.

5. The turbine airfoil of claim 1, wherein a cross-sectional area of the inlet of the converging section is about equal to a cross-sectional area of the outlet of the diverging section.

6. The turbine airfoil of claim 1, wherein the at least one mini-rib extending into the converging-diverging exit slot is nonparallel and nonorthogonal with a cooling fluid flow path axis extending through the converging-diverging exit slot.

7. The turbine airfoil of claim 6, wherein the at least one mini-rib extending into the converging-diverging exit slot has a leading end positioned closer to the second rib than a trailing end and the at least one mini-rib extending into the converging-diverging exit slot has a leading end positioned closer to the first rib than a trailing end.

8. The turbine airfoil of claim 1, wherein the at least one mini-rib extending into the converging-diverging exit slot is offset in a chordwise direction from another at least one mini-rib such that the mini-ribs do not overlap in a direction extending from the pressure side towards the suction side.

9. The turbine airfoil of claim 1, further comprising at least one mini-rib extending from the first rib toward the second rib in the converging section.

10. The turbine airfoil of claim 9, further wherein the at least one mini-rib extends from the second rib toward the first rib in the converging section.

11. The turbine airfoil of claim 10, wherein the at least one mini-rib extending from the first rib is aligned with the at least one mini-rib extending from the second rib.

12. The turbine airfoil of claim 1, further comprising a plurality of cooling fluid flow controllers extending from the outer wall forming the pressure side to the outer wall forming the suction side of the generally elongated hollow airfoil, where the cooling fluid flow controllers form a plurality of alternating zigzag channels extending downstream toward the trailing edge, and wherein the plurality of cooling fluid flow controllers are positioned upstream from the at least one converging-diverging exit slot.

13. The turbine airfoil of claim 12, wherein at least one of the cooling fluid flow controllers is formed by a pressure side that is on an opposite side from a suction side, whereby the pressure and suction sides are coupled together via a leading edge and trailing edge on an opposite end of the at least one cooling fluid flow controller from the leading edge and wherein the pressure side has a generally concave curved surface and the suction side has a generally convex curved surface.

14. The turbine airfoil of claim 13, wherein the plurality of cooling fluid flow controllers are collected into a first spanwise extending row of cooling fluid flow controllers and a second spanwise extending row, wherein each of the cooling fluid flow controllers within the first spanwise extending row of cooling fluid flow controllers is positioned similarly, such that a pressure side of one cooling fluid flow controller is adjacent to a suction side of an adjacent cooling fluid flow controller, except for a cooling fluid flow controller at an end of the first spanwise extending row, and wherein the second spanwise extending row of cooling fluid flow controllers are positioned downstream from the first spanwise extending row of cooling fluid flow controllers.

15. The turbine airfoil of claim 14, wherein the second spanwise extending row of cooling fluid flow controllers has at least one cooling fluid flow controller with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers.

16. The turbine airfoil of claim 1, further comprising a plurality of rows of pin fins extending from the outer wall forming the pressure side to the outer wall forming the suction side and downstream from the cooling fluid flow controllers.

17. A turbine airfoil for a gas turbine engine comprising:

a generally elongated hollow airfoil formed from an outer wall, and having a leading edge, a trailing edge, a pressure side, a suction side and a cooling system positioned within interior aspects of the generally elongated hollow airfoil;

the cooling system includes at least one trailing edge cooling channel positioned at the trailing edge of the airfoil;

wherein the at least one trailing edge cooling channel includes at least one converging-diverging exit slot formed by a first rib extending between the outer wall forming the pressure side and the outer wall forming the suction side and a second rib extending between the outer wall forming the pressure side and the outer wall forming the suction side;

wherein the at least one converging-diverging exit slot is formed from a converging section having an inlet with a larger cross-sectional area than an outlet and is formed from a diverging section having an inlet with a smaller cross-sectional area than an outlet, wherein a chordwise extending length of the converging section is greater than a chordwise extending length of the diverging section.

* * * * *